US008968120B2

(12) United States Patent
Sullivan

(10) Patent No.: US 8,968,120 B2
(45) Date of Patent: Mar. 3, 2015

(54) BASEBALL AND SOFTBALL FIELDING AID

(71) Applicant: Mark Sullivan, Stanley, NC (US)

(72) Inventor: Mark Sullivan, Stanley, NC (US)

( * ) Notice: Subject to any disclaimer, the term of this patent is extended or adjusted under 35 U.S.C. 154(b) by 64 days.

(21) Appl. No.: 13/761,607

(22) Filed: Feb. 7, 2013

(65) Prior Publication Data

US 2013/0203528 A1 Aug. 8, 2013

Related U.S. Application Data

(60) Provisional application No. 61/595,898, filed on Feb. 7, 2012.

(51) Int. Cl.
*A63B 69/00* (2006.01)
*A63B 71/14* (2006.01)

(52) U.S. Cl.
CPC ..... *A63B 69/0002* (2013.01); *A63B 71/143* (2013.01); *A63B 2069/0011* (2013.01); *A63B 2209/00* (2013.01)
USPC ..... 473/458; 473/422

(58) Field of Classification Search
CPC .... A63B 71/00; A63B 71/141; A63B 71/143; A42B 3/14; A42B 3/145
USPC ..... 473/422, 450, 458, 464; 2/16, 19, 20, 2/161.1
See application file for complete search history.

(56) References Cited

U.S. PATENT DOCUMENTS

| | | | | |
|---|---|---|---|---|
| 4,208,051 | A | 6/1980 | Robertson | |
| 4,339,830 | A * | 7/1982 | Sasaki | 2/19 |
| 4,418,849 | A * | 12/1983 | Santa | 2/19 |
| 5,180,165 | A * | 1/1993 | Frost | 473/206 |
| 5,557,803 | A * | 9/1996 | Granich et al. | 2/19 |
| 5,640,712 | A * | 6/1997 | Hansen et al. | 2/20 |
| 5,976,036 | A * | 11/1999 | Jackson | 473/458 |
| 6,292,946 | B1 * | 9/2001 | Angione | 2/20 |
| 6,341,376 | B1 * | 1/2002 | Smerdon, Jr. | 2/16 |
| 6,427,246 | B1 * | 8/2002 | Doi et al. | 2/20 |
| 6,532,594 | B1 * | 3/2003 | Barnett | 2/20 |
| 6,748,600 | B1 * | 6/2004 | Motooka et al. | 2/19 |
| D493,015 | S * | 7/2004 | Murai | D29/123 |
| 7,171,696 | B2 * | 2/2007 | Falone et al. | 2/161.1 |
| RE40,142 | E * | 3/2008 | Fous | 2/19 |
| 7,480,943 | B2 * | 1/2009 | Schmadeka | 2/19 |
| 7,891,017 | B2 * | 2/2011 | Tsukamoto et al. | 2/19 |
| 8,065,744 | B2 * | 11/2011 | Magno | 473/458 |
| 8,370,963 | B2 * | 2/2013 | Laliberty | 2/19 |
| 2013/0145513 | A1 * | 6/2013 | Steiner | 2/19 |

* cited by examiner

*Primary Examiner* — Mitra Aryanpour
(74) *Attorney, Agent, or Firm* — Shumaker, Loop & Kendrick, LLP

(57) ABSTRACT

A fielding aid for a baseball or softball glove having an insert composed of a vibration dampening material for slowing or impeding the movement of a ball; the insert having an interior portion and exterior portion. In certain aspects, the interior portion has a convex shape that aids in fielding balls.

11 Claims, 5 Drawing Sheets

BASEBALL AND SOFTBALL FIELDING AID

BACKGROUND

The ability to catch and quickly field a ball with proper form/technique (i.e., quick feet and soft hands) is a valuable skill in baseball and softball. While standard baseball gloves allow even novice players to catch balls fairly easily, it is common for a novice player to use improper form when fielding the ball. Such improper form can include, but is not limited to, reaching for and only using the glove to catch a ball that is put into play without using proper footwork to center ones body in front of the ball. However, when fielding a ground ball, for example, it is best practice to center ones body in front of the ball and to use both the glove and the free hand to catch the ball. In this instance, it is desired to use the glove to slow or impede the ball while trapping the ball in the glove with ones bare hand (i.e., free hand) and using the free hand to grasp the ball. After properly fielding the ball, the player can then immediately throw the ball to another player using his free hand. In contrast, when a player uses improper form and catches a the ball using only the glove, a player must then reach into the glove with his free hand and retrieve the ball, and these actions can cost the player valuable seconds and prevent effective fielding of the ball. Thus, it is essential to train players to use proper form/technique (e.g., quick feet and soft hands) to secure the ball with their free hand to help prevent potential errors during a game.

U.S. Pat. No. 4,208,051 describes a baseball fielding training aid according to the prior art. A rigid flat plate 4 is used in place of a standard glove and attaches to the hand via straps 8. Thus, while the aid may be used to slow a ball similar to a standard glove, a player using this glove in practice is not able to catch the ball with this glove without using his free hand, thereby forcing the player to develop good fielding habits.

SUMMARY

Some drawbacks of the above described related art includes, but is not limited to, that a player must forcibly put their glove hand in the training glove, which does not have the same weight or feel as a player's standard glove (i.e., the player's "broken in" glove). Thus, these training gloves have a foreign feel and cannot simulate the individual's own glove that is used during game situations. Applicant has therefore recognized a need for a baseball fielding training aid that permits a player to practice fielding (e.g., using quick feet and soft hands) while wearing a standard glove, thereby simulating playing conditions more accurately while still training the player to use both hands when fielding a ball.

Exemplary embodiments are described herein include a baseball fielding training aid, which may be inserted and held in place in a standard player's glove. The insert may have a substantially flat and padded outer face and a rounded (and/or an oval) convex inner face for engaging a concave inner surface (i.e., the palm) of a glove. When mounted in a glove, the training aid fills the palm portion of the glove where a ball would normally be caught and trapped by the glove. The training aid is configured to impede or slow an incoming ball off of the padded outer face while otherwise simulating the properties of the standard glove. Thus, a player may practice using a standard glove, for example, his own personal glove, while gaining the practice and skill benefit of being forced to use both his glove and free hand while fielding a ball.

Another exemplary embodiment includes an insert for a sports glove comprising an exterior portion having a substantially flat exterior surface, the exterior portion being composed of a padded material; an interior portion having a protrusion adapted to fit and nest in an interior recess of a sports glove (e.g., a baseball or softball mitt), such that the interior surface holds the insert in place with respect to the sports glove by friction and/or adhesion.

DETAILED DESCRIPTION OF EMBODIMENTS

Figure 1:
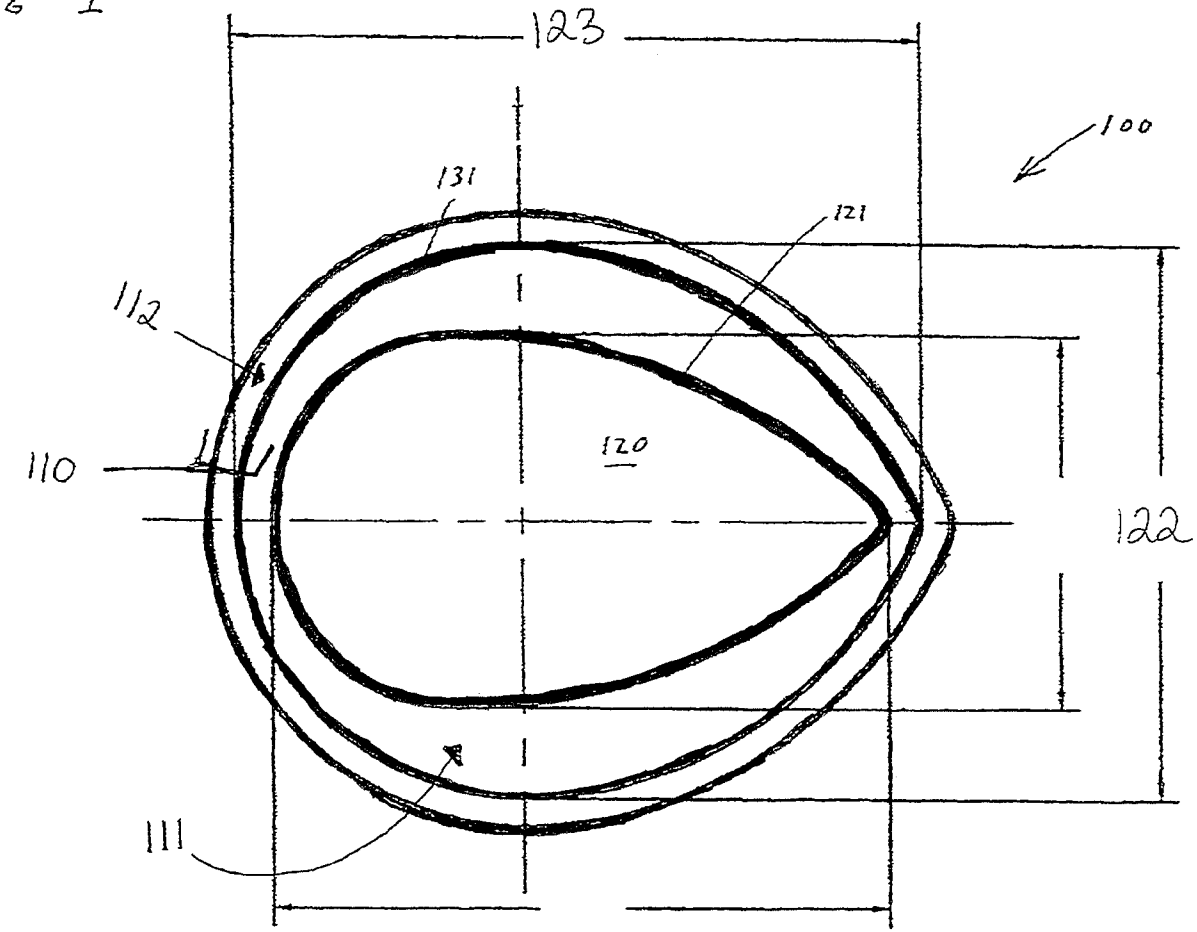
FIG. 1 illustrates a top view of an exemplary embodiment of a fielding aid.

FIG. 1 illustrates a top view of a fielding training aid 100 according to an exemplary embodiment. The device 100 can be oblong shaped so as to insert/fit and nest into a concave inner face (i.e., the palm) of standard playing glove, such as a baseball or softball mitt. The device can be formed of a vibration dampening material that includes, but is not limited to, foam (e.g., a urethane, polyurethane foam, or polyethylene), an elastic material, hard plastic, soft plastic, natural and/or synthetic rubbers (e.g., silicone), polymeric materials (e.g., poly-vinyl chloride, nylon, or derivatives thereof) or any combination thereof. In certain aspects, the vibration dampening material is cross-linked polyethylene or cross-linked polyurethane. In certain aspects, the vibration dampening material has a tensile strength ranging from 50 psi to 100 psi, from 60 psi to 95 psi, from 70 psi to 90 psi, from 75 psi to 85 psi, and from 78 psi to 83 psi when measured by the ASTM D412 testing method. In certain aspects, the vibration dampening material has a shore hardness ranging from 30 shore OO to 70 shore OO, from 45 shore OO to 70 shore OO, from 55 shore OO to 70 shore OO, from 60 shore OO to 70 shore OO, from 62 shore OO to 68 shore OO, and from 63 shore OO to 67 shore OO when measured by the ASTM D624 testing method. In certain aspects, the vibration dampening material has a density ranging from 2 $lb/ft^3$ to 7 $lb/ft^3$, from 2.5 $lb/ft^3$ to 6.5 $lb/ft^3$, from 3.0 $lb/ft^3$ to 6.0 $lb/ft^3$, from 3.5 $lb/ft^3$ to 5.5 $lb/ft^3$, from 4.0 $lb/ft^3$ to 5.0 $lb/ft^3$, and from 4.2 $lb/ft^3$ to 4.8 $lb/ft^3$ when measured by the ASTM D3575 testing method.

In certain aspects, the device can define a generally flat exterior portion 110 (see FIG. 2) for engaging the ball and a raised, convex interior portion 120 that is adapted to nest in an interior recess of the baseball glove defined by the concave inner surface of the glove. The convex interior surface 120 can have a half oval shape including a rounded upper portion (e.g., a circular portion) and a tapered lower portion (e.g., an elongated portion when compared to the rounded upper portion) that defines an interior face 121. The interior face 121 can be formed of or covered with a relatively high friction surface such as suede fabric, synthetic and/or natural adhesives, synthetic and/or natural rubbers, other materials that provide friction, or any combination thereof so that the device can engage and be removably placed in, removably mounted on, or removably connected to an inner surface or inner recess of the glove and to fit securely and nest in the glove. In certain aspects, the inner surface or interior recess of the sports glove includes, but is not limited to, a palm portion of the glove (e.g., the heel and the crease in the palm portion of the glove), a web part of the glove, or a combination thereof. As indicated above, the high friction surface may also have a friction and adhesion levels low enough to permit easy removal of the aid from the glove without damaging or otherwise distressing the glove. The interior portion 120 may also be made of different materials, and in certain aspects, the inner portion can be solid, entirely hollow, or partially hollow, based on factors such as weight and cost for example.

In this embodiment, the exterior portion 110 has a front exterior face 111, a back exterior face 113, and a continuous edge portion 112. In this embodiment, the front exterior face and the back exterior face of the exterior portion 110 oppose one another, and the front exterior face and back exterior face of the exterior portion reside either completely or partially in two non-intersecting planes (e.g., parallel planes). In this embodiment, the continuous edge portion 112 is at the boundary or periphery of the front exterior face and back exterior face, and the continuous edge is in between the front exterior face and the back face of the exterior portion. The continuous edge portion is configured to connect the front face of the exterior face to the back face of the exterior portion. Further in this embodiment, the interior portion 120 is joined to a portion of the back exterior face of the exterior portion by a seam 131. In this embodiment, the interior portion 120 has a length and width in which the width of the interior portion is smaller than an overall width of the back exterior face of the exterior portion. In certain embodiments, the aid may be secured to the glove by a fastener such as a tie or clip. For example, the aid may be secured by threading a tie attached to the interior surface around one or more fingers of the glove to hold the aid in place.

Figure 2:
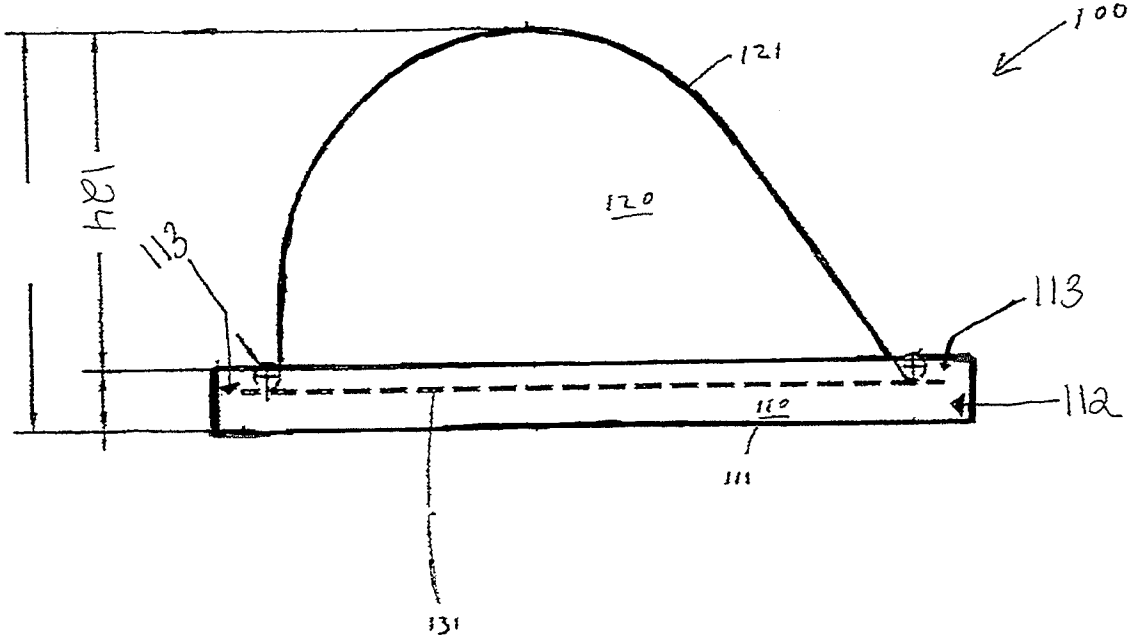
FIG. 2 illustrates a side view of the embodiment of the fielding aid of FIG. 1.
Figure 3:
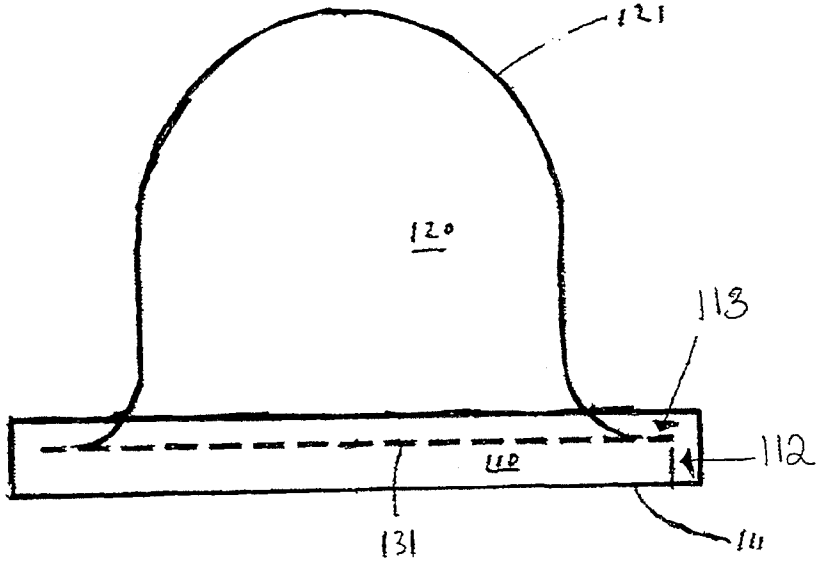
FIG. 3 illustrates an end view of the embodiment of the fielding aid of FIG. 1.

FIG. 2 illustrates a side view of the embodiment of FIG. 1. In this view, the shape of convex interior portion 120 extending away from the flat exterior portion 110 (e.g., the front exterior face 111) is illustrated. The convex interior portion 120 may fit into and substantially fill the interior recess of the glove (e.g., the webbing and heel), that is, the portion of the glove that would otherwise catch and trap a ball. Thus, when catching and fielding a ball, the ball will be slowed and/or impeded by the padded flat outer face 111 while preventing the glove from closing around the ball, thus forcing a practicing player to use his free hand to complete the catch so that the ball can be efficiently fielded. FIG. 3 illustrates an end view of the embodiment shown by FIG. 1.

The specific shape and proportions shown by FIGS. 1-3 are not necessarily required, and may be modified to accommodate different shapes, sizes, and styles of different fielding gloves and mitts. For example, the aid of FIGS. 1-3 has a total width (122) of between 5 and 6 inches and a total length (123) of 7 to 8 inches, such that the flat outer surface has an area of approximately 25 to 35 square inches, and the convex interior portion extends (124) approximately 3.5 to 4 inches away from the back exterior face of the exterior portion. These approximate dimensions are sized to fit in a variety of standard baseball and softball mitts. For example, the aid described herein can fit various glove sizes ranging from size 10 to 12.5, from size 10 to 10.5, from size 10.5 to 11, from size 11 to 11.5, from size 11 to 11.5, and from size 12 to 12.5. In certain aspects, the glove sizes can include 10, 10.5, 11, 11.5, 12, and 12.5, and any range of glove sizes (chosen from the glove sizes immediately above) can be used. However, while the interior portion 120 and interior face 121 are shaped and sized in this embodiment to accommodate a large variety of different gloves and sizes, the specific shape and contour of the interior portion may be customized. For example, the shape of exterior portion 110, front exterior face 111, back exterior face 113, and interior portion 120 and face 121 may be adjusted to specifically fit either a right or left handed glove and/or may be customized to fit gloves for different field positions. In certain aspects, the training aid substantially covers the interior recess of the glove. The training aid may be made to fit more securely in a glove, to better prevent the aid from accidentally falling from the glove for example, or less securely, to ease insertion and removal of the training aid during practice for example. The flat exterior surface may be covered with a polyurethane foam to created the padded surface, or may be composed of a more or less resilient material, based on, for example, a desired degree of difficulty when attempting to field a ball in play.

Figure 4:
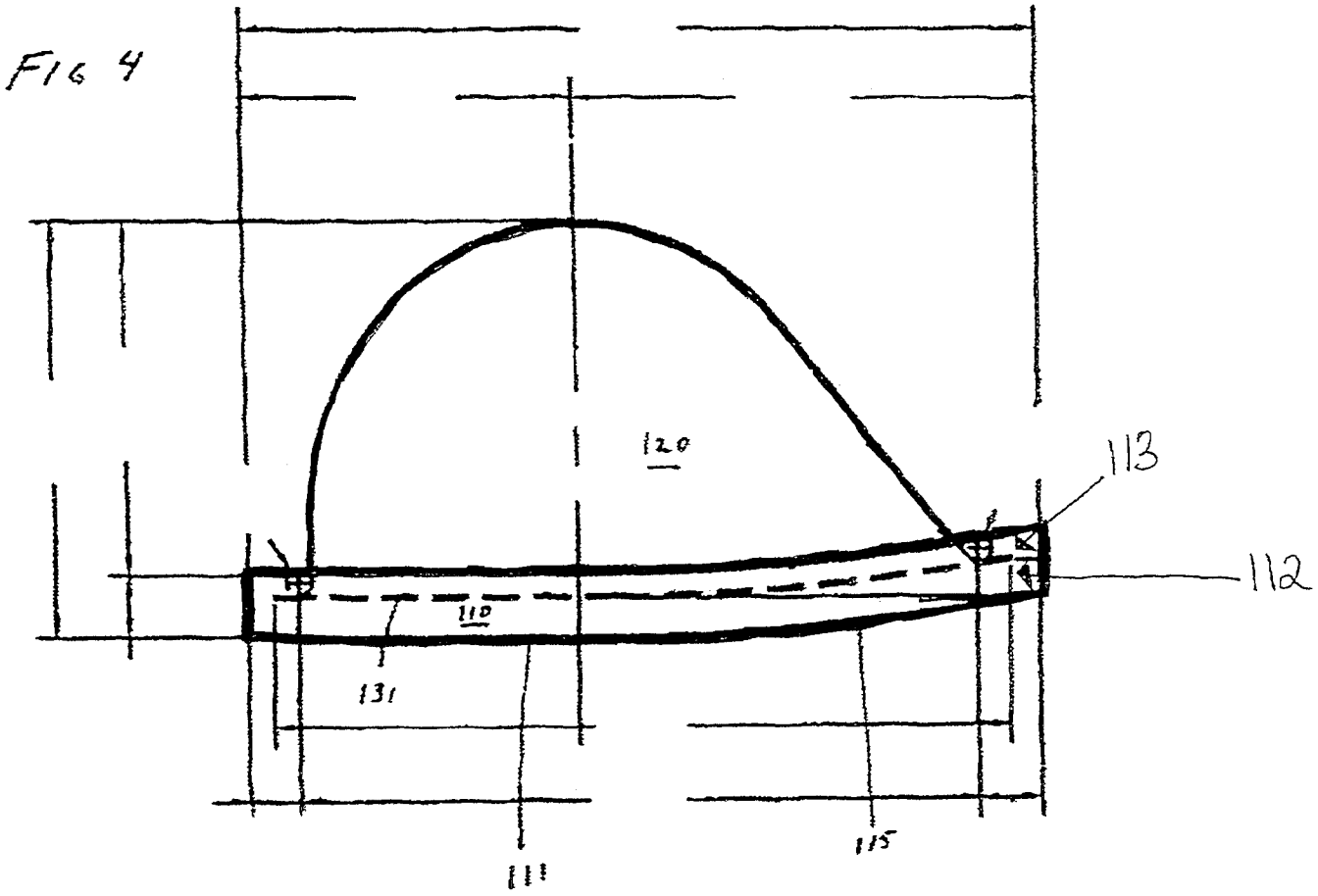
FIG. 4 illustrates a side view of an alternative embodiment of a fielding aid.
Figure 5:
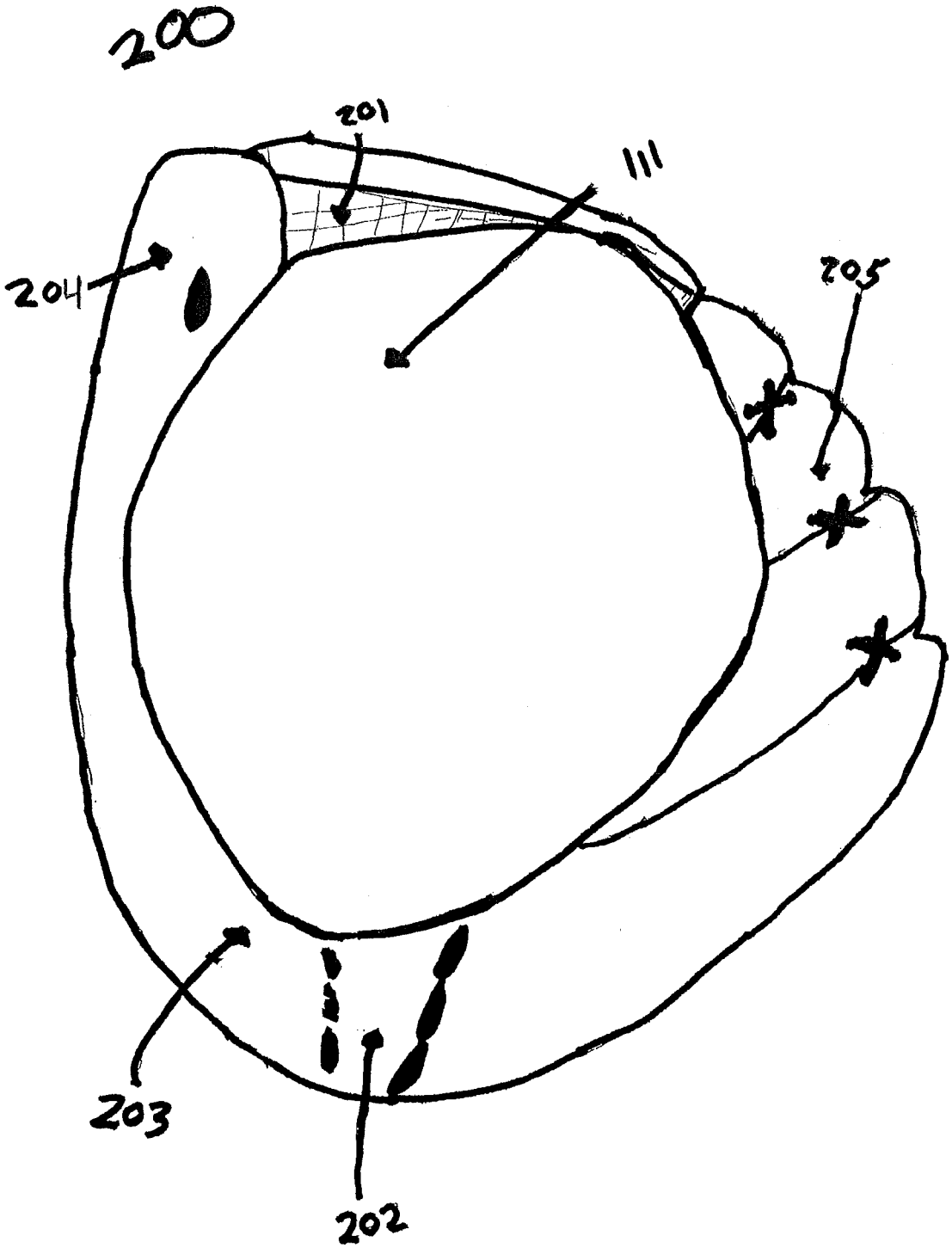
FIG. 5 illustrates the fielding aid inserted into a baseball or softball glove.

The shape and contour of the exterior portion 110 may also be customized to increase or decrease the ability to accurately field the ball. For example, FIG. 4 discloses an alternative embodiment in which a portion 115 of the exterior portion 110 is curved away from the main plane of the front exterior face 111. This curved portion 115 is adapted to be nested in the portion of the glove closest to the wrist (e.g., 202 and 203 as shown in FIG. 5). In another embodiment, the exterior portion (e.g., the front exterior face) may be formed as a slightly concave surface to reduce the level of difficulty of slowing and impeding the ball while still requiring use of the player's free hand to grasp and field the ball.

FIG. 5 shows the fielding aid being inserted into a baseball or softball glove 200. Specifically, FIG. 5 shows the front exterior face 111 of the exterior portion of the fielding aid being inserted into a recess portion of the baseball or softball glove. As described above, the recess portion can include, for example, the glove's web 201 and additional portions of the glove including the heel 203 and a crease portion 202. As further shown in FIG. 5, the exterior portion (e.g., the front exterior face 111 of the exterior potion) is configured to insert between a first finger portion and at least a second finger portion 205 of the baseball or softball glove, wherein the first finger portion of the baseball or softball glove is the thumb portion 204 of the baseball or softball glove. In certain aspects, the fielding aid is configured to insert between the thumb portion 204 of the baseball or softball glove and at least a second and a third finger portion. In certain aspects, the fielding aid is configured to insert between the thumb portion 204 of the baseball or softball glove and at least a second finger portion, a third finger portion, and a fourth finger portion. In yet another aspect, the fielding aid is configured to insert between the thumb portion 204 of the baseball or softball glove and a second finger portion, a third portion, a fourth finger portion, and a fifth finger portion.

An advantage of these embodiments is that the aid can be easily inserted and removed from the glove during practice. Another advantage of this arrangement is that the player is not required to remove the glove itself prior to inserting or removing the training aid.

The foregoing descriptions of specific embodiments have been presented for purposes of illustration and description. They are not intended to be exhaustive or to limit the invention to the precise forms disclosed, and obviously many modifications and variations are possible in light of the above teaching. The embodiments were chosen and described in order to best explain principles and practical applications of the invention, and to thereby enable others skilled in the art to best utilize the invention and various embodiments with various modifications as are suited to the particular use contemplated. It is understood that various omissions and substitutions of equivalents are contemplated as circumstances may suggest or render expedient, but these are intended to cover the application or implementation without departing from the spirit or scope of the claims of the present invention.

What is claimed is:

1. A removably attachable fielding aid for use with a baseball or softball glove, the fielding aid comprising:

a back portion and a front portion positioned opposite the back portion, the back and front portions each comprising a vibration dampening material for slowing or impeding the movement of a ball, wherein:

the front portion comprises a continuous, flat front exterior face, a continuous, flat back exterior face, and a continuous edge portion, the continuous edge portion positioned in between the front exterior face of the exterior portion and the back exterior face of the exterior portion such that the continuous, flat front exterior face and the back exterior face of the exterior portion are connected;

the back portion comprises a convex-shaped protrusion farmed on the continuous, flat back exterior face having an overall width that is smaller than an overall width of the continuous, flat back exterior face of the front portion;

the back and front portions are configured to be positioned on an exterior recess of the baseball and softball glove; and the back portion is configured to contact a web and heel portion of the baseball or softball glove such that the removably attachable fielding aid is securely positioned on the exterior recess of the baseball or softball glove while in use.

2. The removably attachable fielding aid of claim 1, wherein the back portion and the back exterior face of the front portion are connected to each other and form a seam where the back portion and the back exterior face of the front portion are connected to each other.

3. The removably attachable fielding aid of claim 1, wherein the exterior recess of the baseball or softball glove is a palm portion of the glove, the web portion of the glove, and the heel portion of the glove.

4. The removably attachable fielding aid of claim 3, wherein at least a portion of the aid covers the exterior recess of the baseball or softball glove.

5. The removably attachable fielding aid of claim l, wherein the convex-shaped protrusion is a half oval shape; and a first portion of the convex-shaped protrusion is configured to be closer to the heel portion of the baseball or softball glove when nested within the baseball or softball glove; and a second portion of the convex-shaped protrusion is configured to be closer to the web portion of the baseball or softball glove when nested within the baseball or softball glove.

6. The removably attachable fielding aid of claim 5, wherein the first portion of the convex-shaped protrusion is more elongate than the second portion of the convex-shaped protrusion and the second portion of the convex-shaped protrusion being more circular in shape than the first portion of the convex-shaped protrusion.

7. The removably attachable fielding aid of claim 1, wherein the front portion is configured to securely insert between a first finger portion and a second finger portion of the baseball or softball glove, wherein the first finger portion of the baseball or softball glove is the thumb portion of the baseball or softball glove.

8. The removably attachable fielding aid of claim 6, wherein a surface of the convex-shaped protrusion includes a substance that increases friction between the fielding aid and the baseball or softball glove, wherein the substance is selected from the group consisting of suede fabric, synthetic adhesives, natural adhesives, synthetic rubbers, and natural rubbers.

9. The removably attachable fielding aid of claim 8, wherein at least a surface of the second portion of the convex-shaped protrusion includes a substance configured to increase friction between the fielding aid and the baseball or softball glove, wherein the substance is selected from the group consisting of suede fabric, synthetic adhesives, natural adhesives, synthetic rubbers, and natural rubbers.

10. The removably attachable fielding aid of claim 1, wherein the vibration dampening material comprises a polyurethane foam.

11. The removably attachable fielding aid of claim 1, wherein the vibration dampening material comprises a cross-linked polyethylene foam having a tensile strength ranging from 70 psi to 90 psi, a shore hardness ranging from 62 shore OO to 68 shore OO, and density ranging from 3.0 $lb/ft^3$ to 6.0 $lb/ft^3$.

* * * * *